US008536855B2

(12) United States Patent
Yen Mai et al.

(10) Patent No.: US 8,536,855 B2
(45) Date of Patent: Sep. 17, 2013

(54) ADJUSTABLE SHUNT REGULATOR CIRCUIT WITHOUT ERROR AMPLIFIER

(75) Inventors: Tony Yuan Yen Mai, Kowloon (HK); Isaac Terasuth Ko, Kowloon (HK)

(73) Assignee: Supertex, Inc., Sunnyvale, CA (US)

( * ) Notice: Subject to any disclaimer, the term of this patent is extended or adjusted under 35 U.S.C. 154(b) by 490 days.

(21) Appl. No.: 12/786,322

(22) Filed: May 24, 2010

(65) Prior Publication Data

US 2011/0285363 A1 Nov. 24, 2011

(51) Int. Cl.
*G05F 3/16* (2006.01)
*G05F 3/20* (2006.01)

(52) U.S. Cl.
USPC ..... 323/317; 323/313; 323/315

(58) Field of Classification Search
USPC ..... 323/223, 313, 315, 317
See application file for complete search history.

(56) References Cited

U.S. PATENT DOCUMENTS

| | | | | |
|---|---|---|---|---|
| 4,810,902 | A * | 3/1989 | Storti et al. | 326/89 |
| 6,201,381 | B1 * | 3/2001 | Yasuda | 323/315 |
| 6,407,537 | B2 * | 6/2002 | Antheunis | 323/312 |
| 2005/0083030 | A1 * | 4/2005 | Ito et al. | 323/315 |
| 2010/0283448 | A1 * | 11/2010 | Lu et al. | 323/315 |

* cited by examiner

*Primary Examiner* — Adolf Berhane
*Assistant Examiner* — Gary Nash
(74) *Attorney, Agent, or Firm* — DLA Piper LLP (US)

(57) ABSTRACT

An adjustable shunt regulator circuit has two current paths in parallel, with each current path having a bipolar transistor therein with the bases of the bipolar transistors of the two current paths connected in common. One of the current paths has a high impedance node. A MOS transistor has a gate connected to the high impedance node, and a source and a drain. A resistor divide circuit is connected in parallel to the source and drain of the MOS transistor and provides the output of the regulator circuit. The resistor divide circuit has a first resistor connected in series with a second resistor at a first node. A feedback connects the first node to the bases of the bipolar transistors connected in common of the two current paths.

7 Claims, 4 Drawing Sheets

ADJUSTABLE SHUNT REGULATOR CIRCUIT WITHOUT ERROR AMPLIFIER

TECHNICAL FIELD

The present invention relates to an adjustable shunt regulator circuit and more particularly to a circuit that is power efficient and low cost.

BACKGROUND OF THE INVENTION

Bandgap shunt regulator circuits are well known in the art. Referring to FIG. 1 there is shown a bandgap shunt regulator circuit 10 of the prior art. The circuit 10 uses bipolar transistors Q1, Q2, Q4, Q7 and Q9 to produce a stable output low voltage reference, on the order of 1.22 volts. The circuit 10 is typically used for low voltage, i.e. less than 5 volts where Zener diodes are not suitable. In the circuit 10, the emitter of transistor Q2 is larger than the emitter of transistor Q1. As an example shown in FIG. 1 the emitter of transistor Q2 is 16 times larger than the emitter of transistor Q1. As a result, transistor Q2 with the larger emitter area requires a smaller base-emitter voltage for the same current than for the transistor Q1. The delta between the base-emitter voltage of transistor Q1 and that of the transistor Q2 is amplified by a factor of about 10 and added to the base-emitter voltage of transistor Q1. The total of these two voltages add up to approximately 1.22 v, which is the approximate bandgap of silicon at 0 degrees K. The circuit 10 has the benefit of the accuracy of the Vbe term which decreases at a rate of about −2 mV/C degree. However, the circuit 10 can provide its ideal voltage only at about 1.22V for low temperature coefficient, and thus is not adjustable for voltage larger than 1.22 volts.

Referring to FIG. 2, there is shown an adjustable shunt regulator circuit 20 of the prior art. In the circuit 20, the voltage applied to resistor R1 and R2 drops when the output voltage drops due to a variation of the load. This then lowers the voltage of V1, which is the output voltage divided by R1 and R2. Thus, the non-inverting input voltage of the error amplifier is also lowered, below the internal reference voltage Vref. As a result, the error amplifier produces the base voltage of transistor TR, which suppresses the collector current. This then raises the output voltage and stabilizes it. Conversely, when the output voltage rises due to a variation of the load, V1 also rises, causing the error amplifier to raise the base voltage of TR. This then increases the collector current of the transistor TR, which lowers the output voltage and stabilizes it. Thus, the circuit 20 operates to ensure that V1 is always equivalent to the internal reference voltage Vref. The circuit 20 has the advantage that the output Vout ($Vout=(1+R1/R2)\times Vref$) is adjustable (by changing R1 and R2), from Vref to the maximum voltage of the processing technology. However, the circuit 20 suffers from the disadvantage of having additional offset error and increased power consumption because of the error amplifier.

Referring to FIG. 3 there is shown a Brokaw bandgap reference cell 30 of the prior art. The cell 30 comprises a first NPN bipolar transistor T1, and a second NPN bipolar transistor T2, with the emitter of the first transistor T1 larger than the emitter of transistor T2. A resistor R3 is connected to the emitter of the transistor T1 to the emitter of transistor T2. A resistor R4 connects resistor R3 to ground. Each of the transistors T1 and T2 also has a load: R1 and R2 respectively, connected to the collector of the transistor T1 and T2, respectively. The load may be a resistor. An error amplifier has its inputs from the collector of the transistors T1 and T2 and supplies an output which is connected to the ends of the loads R1 and R2 and also to the bases of the transistor T1 and T2. The output of the error amplifier also provides the output of the Brokaw cell 30. In operation, transistor T1 with the larger emitter area requires a smaller base-emitter voltage for the same current. The base-emitter voltage for either transistor T1 or T2 has a negative temperature coefficient i.e., it decreases with temperature. Further, the difference between the two base-emitter voltages has a positive temperature coefficient i.e., it increases with temperature. As a result, the output of the cell 30 is the sum of the base-emitter voltage difference with one of the base-emitter voltages. With proper component choices, the two opposing temperature coefficients can cancel each other exactly and the output will have no temperature dependence. However, again because an error amplifier is used in the Brokaw cell 30, it is subject to additional offset error and increased power consumption because of the error amplifier.

SUMMARY OF THE INVENTION

An adjustable shunt regulator circuit comprises two current paths in parallel, with each current path having a bipolar transistor therein with the bases of the bipolar transistors of the two current paths connected in common. One of the current paths has a high impedance node. A MOS transistor has a gate connected to the high impedance node, and a source and a drain. A resistor divide circuit is connected in parallel to the source and drain of the MOS transistor and provides the output of the regulator circuit. The resistor divide circuit has a first resistor connected in series with a second resistor at a first node. A feedback connects the first node to the bases of the bipolar transistors connected in common of the two current paths.

DETAILED DESCRIPTION OF THE PREFERRED EMBODIMENT

Figure 1:
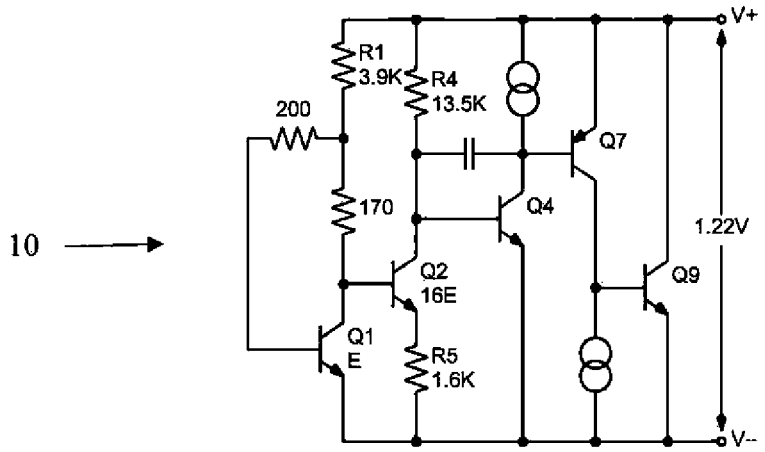
Figure 1 (Prior Art)
FIG. 1 is a circuit diagram of a shunt regulator circuit of the prior art.
Figure 2:
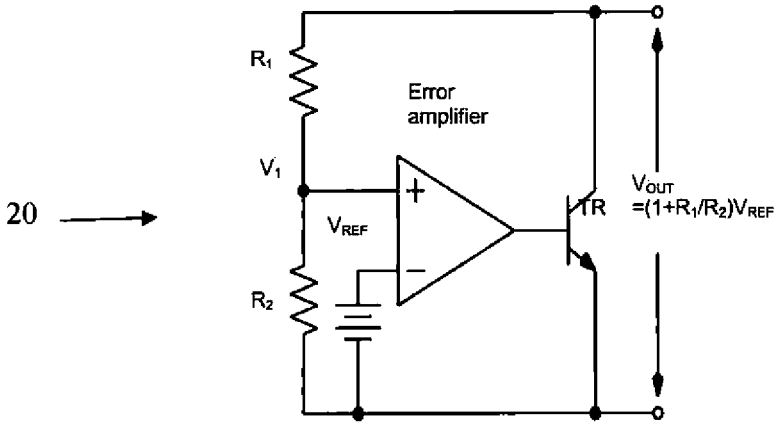
Figure 2 (Prior Art)
FIG. 2 is a circuit diagram of an adjustable shunt regulator of the prior art.
Figure 3:
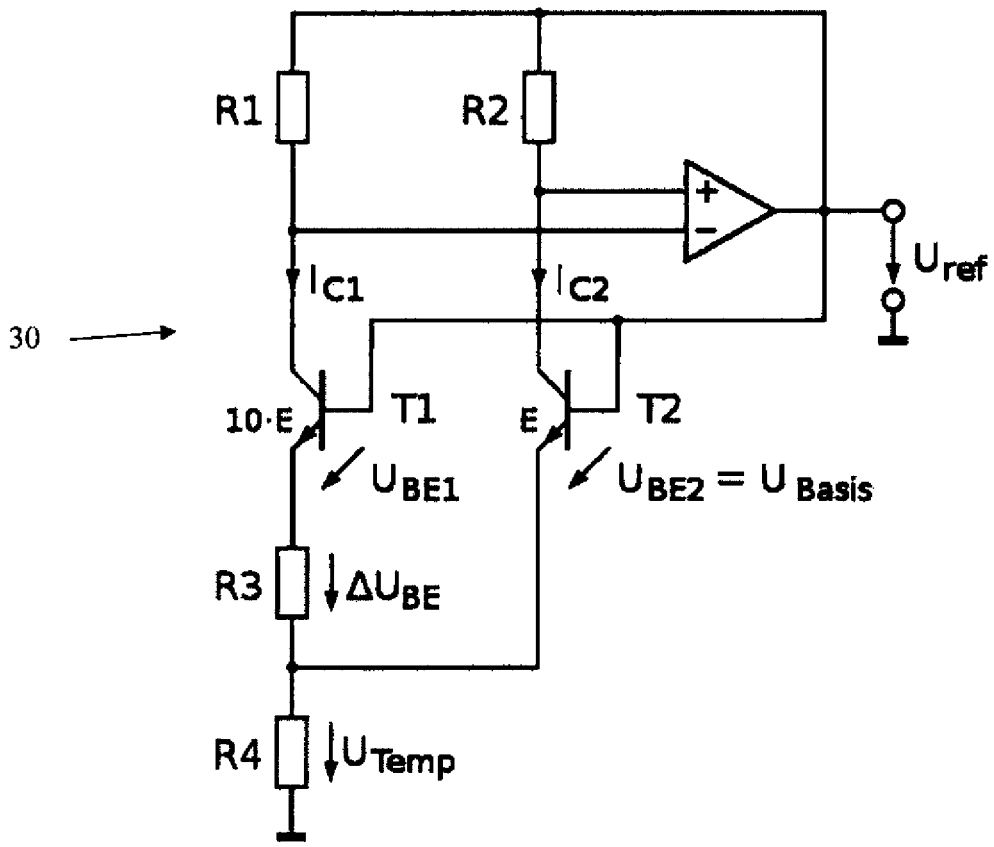
Figure 3 (Prior Art)
FIG. 3 is a circuit diagram of a Brokaw cell of the prior art.
Figure 4:
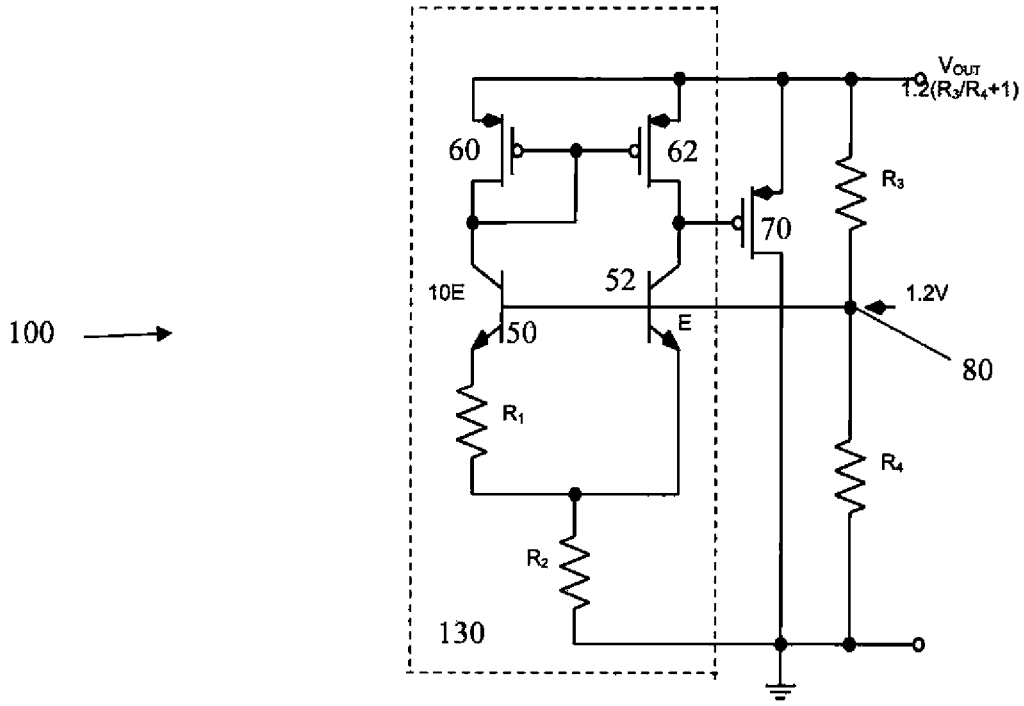
FIG. 4 is a circuit diagram of a first embodiment of the adjustable shunt regulator circuit the present invention.

Referring to FIG. 4 there is shown a first embodiment of an adjustable shunt regulator circuit 100 of the present invention. The circuit 100 has a subcircuit 130 that is similar to the Brokaw cell 30 shown in FIG. 3, except the subcircuit 130 does not have any error amplifier. The subcircuit 130 comprises two current paths, in parallel. A NPN bipolar transistor is in each current path. Thus, a NPN bipolar transistor 50 is shown in one current path, while the bipolar NPN transistor 52 is in the other current path. The emitter of the bipolar transistor 50 is approximately 10 time larger than the emitter of the bipolar transistor 52. A resistor R1 has a first end connected to the emitter of the transistor 50. The other end of the resistor R1 is connected to the emitter of the transistor 52. A resistor R2 is connected to the emitter of transistor 52 and to ground.

Similar to the Brokaw cell 30 shown in FIG. 3, a load is connected to the collector of each of the bipolar transistors 50 and 52 in the two current paths. The load can be resistors, as shown in FIG. 3 or they can be PMOS load transistors. Thus PMOS load transistor 60, has its gate connected to its drain which is connected to the collector of the NPN transistor 50. The gates of the PMOS load transistors 60 and 62 are connected together. The sources of the PMOS transistors 60 and 62 are connected together and form an output to the circuit 100.

A PMOS transistor 70 has a gate, source and a drain and is connected to the subcircuit 130 as follows. The gate is connected to the drain of the PMOS load transistor 62, which is a high impedance node. The source of the PMOS transistor 70 is connected to the sources of the PMOS load transistors 60 and 62. Finally, the drain of the PMOS transistor 70 is connected to the end of the resistor R2, which is connected to ground.

A resistor divide circuit comprises a resistor R3 connected in series to a resistor R4, at a node 80. The node 80 is connected to the bases of the bipolar transistors 50 and 52, and provides a feedback thereto.

In the operation of the circuit 100, the output at node 80 is connected to the common base of the bipolar transistors 50 and 52, which potentially is the sum of the amplified delta base-emitter voltage across R2 and the base-emitter voltage of the transistor 52. This is approximately 1.2V which is the bandgap of silicon at 0 degrees K. Finally, the voltage output provided by the source of the PMOS transistor 70 is as follows: Vout=1.2 (output at Node 80)*(1+R3/R4). Thus, through the choice of the resistance of R3 and R4, the output voltage Vout can be adjusted, from approximately 1.2 volts and up depending upon the process technology used.

Figure 5:
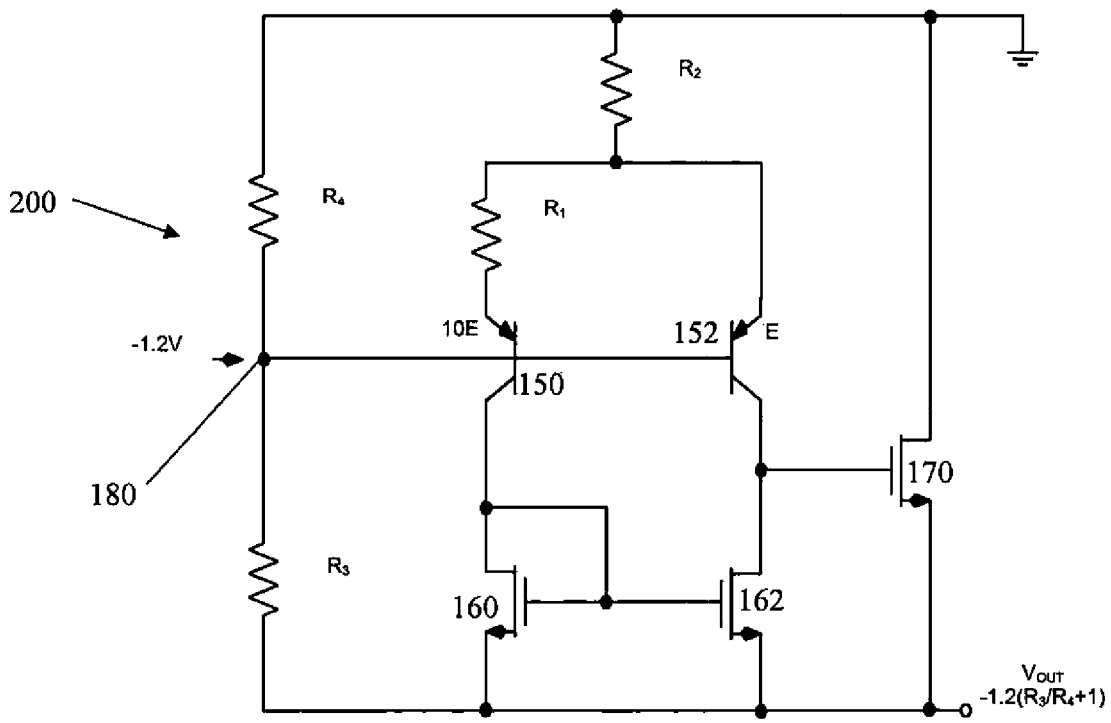
FIG. 5 is a circuit diagram of a second embodiment of the adjustable shunt regulator circuit the present invention.

Referring to FIG. 5 there is shown a second embodiment of an adjustable shunt regulator circuit 200 of the present invention. The circuit 200 is similar to the first embodiment 100 shown in FIG. 4. The only difference is that a NMOS transistor 170 is used instead of the PMOS transistor 70. Further, the PMOS load transistors 60 and 62 are replaced by NMOS transistors 160 and 162, respectively. Finally, the NPN bipolar transistors 50 and 52 are replaced by PNP bipolar transistors 150 and 152, respectively. In all other aspects the connection of the elements is identical to the circuit 100 shown in FIG. 4. Thus, the circuit 200 comprises two current paths, in parallel. A PNP bipolar transistor is in each current path. Thus, a PNP bipolar transistor 150 is shown in one current path, while the bipolar PNP transistor 152 is in the other current path. The emitter of the bipolar transistor 150 is approximately 10 time larger than the emitter of the bipolar transistor 152. A resistor R1 has a first end connected to the emitter of the transistor 150. The other end of the resistor R1 is connected to the emitter of the transistor 152. A resistor R2 is connected to the emitter of transistor 152 and to ground.

A load is connected to the collector of each of the bipolar transistors 150 and 152 in the two current paths. The load can be resistors, as shown in FIG. 3 or they can be NMOS load transistors. Thus NMOS load transistor 160 has its gate connected to its drain which is connected to the collector of the respective PNP transistor 150. The gates of the NMOS load transistors 160 and 162 are connected together. The sources of the NMOS transistors 160 and 162 are connected together and form an output to the circuit 200.

A NMOS transistor 170 has a gate connected to the drain of the NMOS load transistor 162, which is a high impedance node. The source of the NMOS transistor 170 is connected to the sources of the NMOS load transistors 160 and 162. Finally, the drain of the NMOS transistor 170 is connected to the end of the resistor R2, which is connected to ground.

A resistor divide circuit comprises a resistor R3 connected in series to a resistor R4, at a node 180. The node 180 is connected to the bases of the bipolar transistors 150 and 152, and provides a feedback thereto.

The operation of the circuit 200 is similar to the operation of the circuit 100, except the output voltage Vout can be a negative voltage. Thus, Vout=−1.2 (output at Node 80)*(1+R3/R4)

As can be seen from the foregoing, the circuits 100 and 200 achieve their advantages without the use of any error amplifier, and as a result, the accuracy of the output Vout is immune to the input offset of the error amplifier. Further it is adjustable, through the choice of external resistors, simple in design, has low power consumption and zero offset voltage.

What is claimed is:

1. An adjustable regulator circuit comprising:

a first current path having a first bipolar transistor, having a collector, an emitter and a base;

a second current path having a second bipolar transistor, having a collector, an emitter and a base, with the emitter of the second bipolar transistor smaller than the emitter of the first bipolar transistor;

a first load having a first end connected to the emitter of the first bipolar transistor, and a second end connected to the emitter of the second bipolar transistor;

a second load having a first end connected to the second end of first load, and a second end;

a third load having a first end connected to the collector of the first bipolar transistor, and a second end;

a fourth load having a first end connected to the collector of the second bipolar transistor, and a second end;

a MOS transistor having a source, a drain and a gate, with the gate connected to the collector of the second bipolar transistor; and the source connected to the second ends of third load and the fourth load; and the drain connected to the second end of the second load; and a resistive load having two resistors connected in series at a node, said resistive load having a first end connected to the source of the MOS transistor and a second end connected to the drain of the MOS transistor, and with the node connected to the bases of the first and second bipolar transistors.

2. The regulator circuit of claim 1 wherein each of said first and second bipolar transistor is a NPN transistor, and the MOS transistor is a PMOS transistor.

3. The regulator circuit of claim 1 wherein each of said first and second loads is a resistor.

4. The regulator circuit of claim 1 wherein each of said third and fourth loads is a PMOS load transistor, having a source, a drain and a gate, with the gates connected together and to the collector of the first bipolar transistor, the drain of the first PMOS load transistor connected to the collector of the first bipolar transistor, and the drain of the second PMOS load transistor connected to the collector of the second bipolar transistor.

5. The regulator circuit of claim 1 wherein each of said first and second bipolar transistor is a PNP transistor, and the MOS transistor is a NMOS transistor.

6. The regulator circuit of claim 1 wherein each of said first and second loads is a resistor.

7. The regulator circuit of claim 1 wherein each of said third and fourth loads is a NMOS load transistor, having a source, a drain and a gate, with the gates connected together and to the collector of the first bipolar transistor, the drain of the first NMOS load transistor connected to the collector of the first bipolar transistor, and the drain of the second NMOS load transistor connected to the collector of the second bipolar transistor.

* * * * *